United States Patent [19]

Ekenberg

[11] 4,430,949

[45] Feb. 14, 1984

[54] SHAVINGS—OR CHIPS—FIRED BURNER UNIT FOR HEATING BOILERS

[76] Inventor: Åke Ekenberg, Söderby, 762 00 Rimbo, Sweden

[21] Appl. No.: 325,438

[22] PCT Filed: Mar. 31, 1981

[86] PCT No.: PCT/SE81/00103

§ 371 Date: Nov. 20, 1981

§ 102(e) Date: Nov. 20, 1981

[87] PCT Pub. No.: WO81/02922

PCT Pub. Date: Oct. 15, 1981

[30] Foreign Application Priority Data

Apr. 1, 1980 [SE] Sweden ..... 8002478

[51] Int. Cl.[3] ..... F23N 5/24

[52] U.S. Cl. ..... 110/193; 110/102; 110/110; 110/224

[58] Field of Search ..... 110/102, 110, 185, 186, 110/196, 193, 224, 225, 227, 228, 234; 220/4 C

[56] References Cited

U.S. PATENT DOCUMENTS

| | | | |
|---|---|---|---|
| 2,291,790 | 8/1942 | Burton | 110/185 |
| 3,046,915 | 7/1962 | Ludin | 110/225 |
| 3,485,408 | 12/1969 | Benesch | 220/4 C |
| 4,167,909 | 9/1979 | Dauvergne | 110/228 |
| 4,257,338 | 3/1981 | Chasek | 110/234 |
| 4,280,415 | 7/1981 | Wirguin et al. | 110/234 |

*Primary Examiner*—Edward G. Favors
*Assistant Examiner*—Steven E. Warner
*Attorney, Agent, or Firm*—Birch, Stewart, Kolasch & Birch

[57] ABSTRACT

The invention relates to a burner unit for shavings or chips. It is particularly intended for firing with raw shavings or raw chips in a boiler (1). It is provided with a stoker apparatus (2) for feeding the shavings or chips to the boiler. It has further a predesiccation chamber (11, 21, 23, 27, 28) which is built up in the combustion chamber (12) of the boiler (1).

6 Claims, 14 Drawing Figures

Fig.4
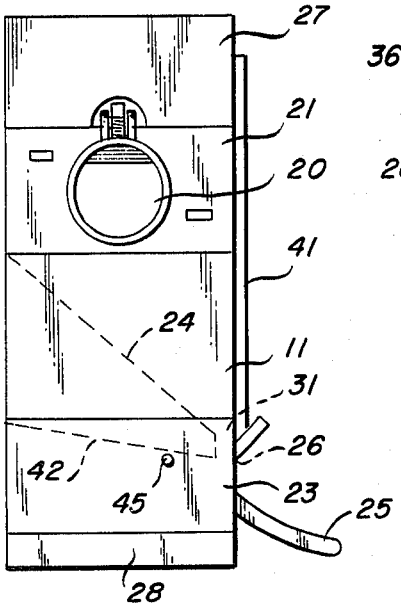
Fig. 5
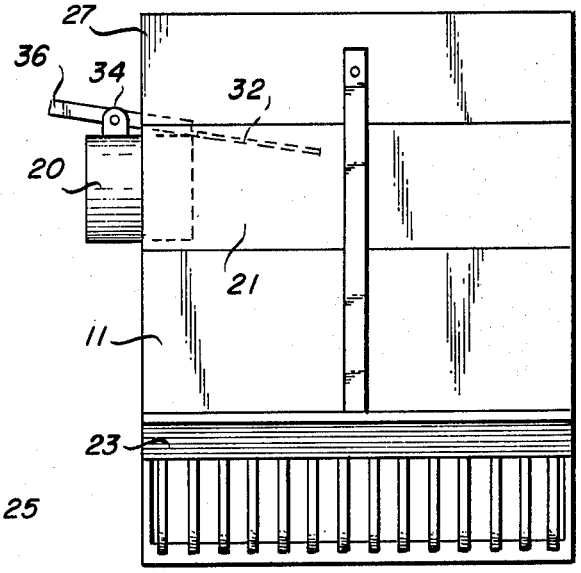
Fig.6
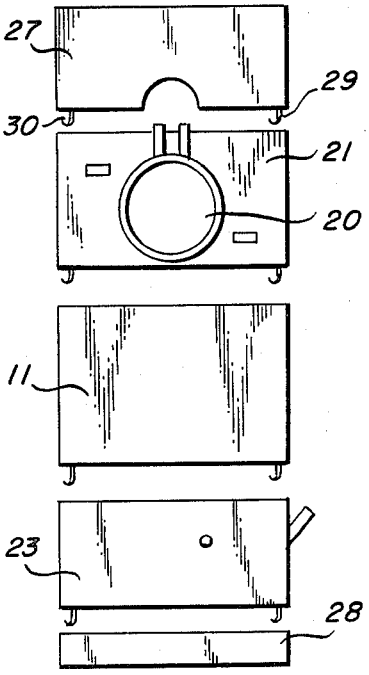
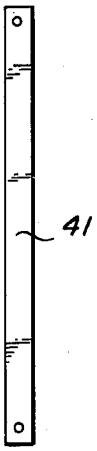
Fig.7
Fig.8
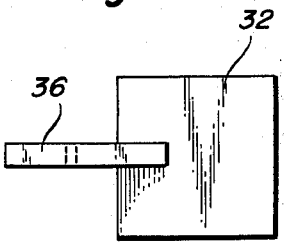

Fig. 9
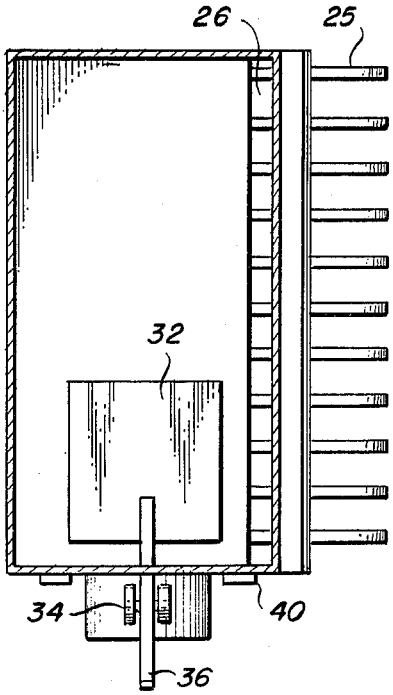
Fig. 10
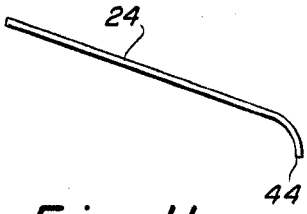
Fig. 11
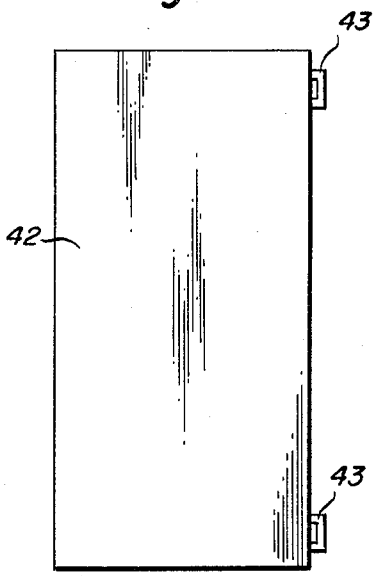
Fig. 12
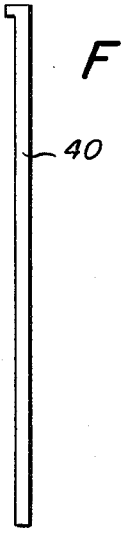
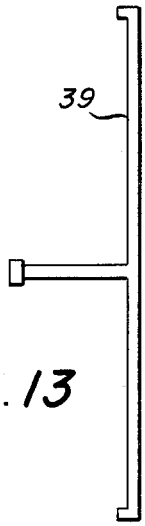
Fig. 13
Fig. 14
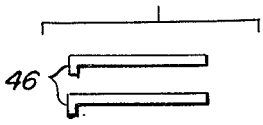

SHAVINGS—OR CHIPS—FIRED BURNER UNIT FOR HEATING BOILERS

The present invention relates to a burner unit for shavings or chips, hereinafter referred to as chips, for firing in a heating boiler provided with a stoker apparatus for feeding the chips to the boiler.

What is novel and characteristic for the unit in accordance with the invention is primarily that the stoker plant is connected to a charging stub in an upper portion of the boiler, that a predesiccating chamber is built up in the combustion chamber of the boiler, and adapted at its upper end to receive the chips fed in through the charging stub, that a control apparatus is formed for regulating the quantity of chips fed by the stoker plant to the chip chamber and that the predesiccating chamber contains a chip chamber and is built up inside the combustion room of the boiler above the fire bars of the boiler and at its lower part is formed with a combustion part for the chips, and that a sloping plane is arranged in the chip chamber for feeding the chips to an adjustable firing grid in the combustion part, where the chips are ignited, said firing grid being arranged at an outlet under the chips chamber, said outlet being the outlet from the chip chamber for the chips which have been predried.

BRIEF DESCRIPTION OF THE DRAWINGS

One embodiment of the burner unit in accordance with the invention will be described in the following while referring to the appended drawings whereon:

FIG. 4 illustrates the parts of the chip chamber from FIG. 2 in detail, FIG. 5 illustrates the chip chamber according to FIG. 4 seen from the side with the combustion part for the chips in its lower portion, FIG. 6 illustrates the parts of the chip chamber according to FIG. 4 in an exploded view, FIG. 7 illustrates a connecting iron, FIG. 8 illustrates a regulating means associated with the control apparatus, FIG. 9 illustrates the sloping plane and firing grid in the chip chamber seen from above, FIG. 10 illustrates the sloping plane seen from one side, FIG. 11 illustrates a supplementation to the sloping plane, FIG. 12 illustrates a bar for a hinge means for the firing grid, FIG. 13 illustrates a device for adjusting the firing grid and FIG. 14 illustrates hooks for the burner unit.

DETAILED DESCRIPTION OF THE INVENTION

Figure 1:
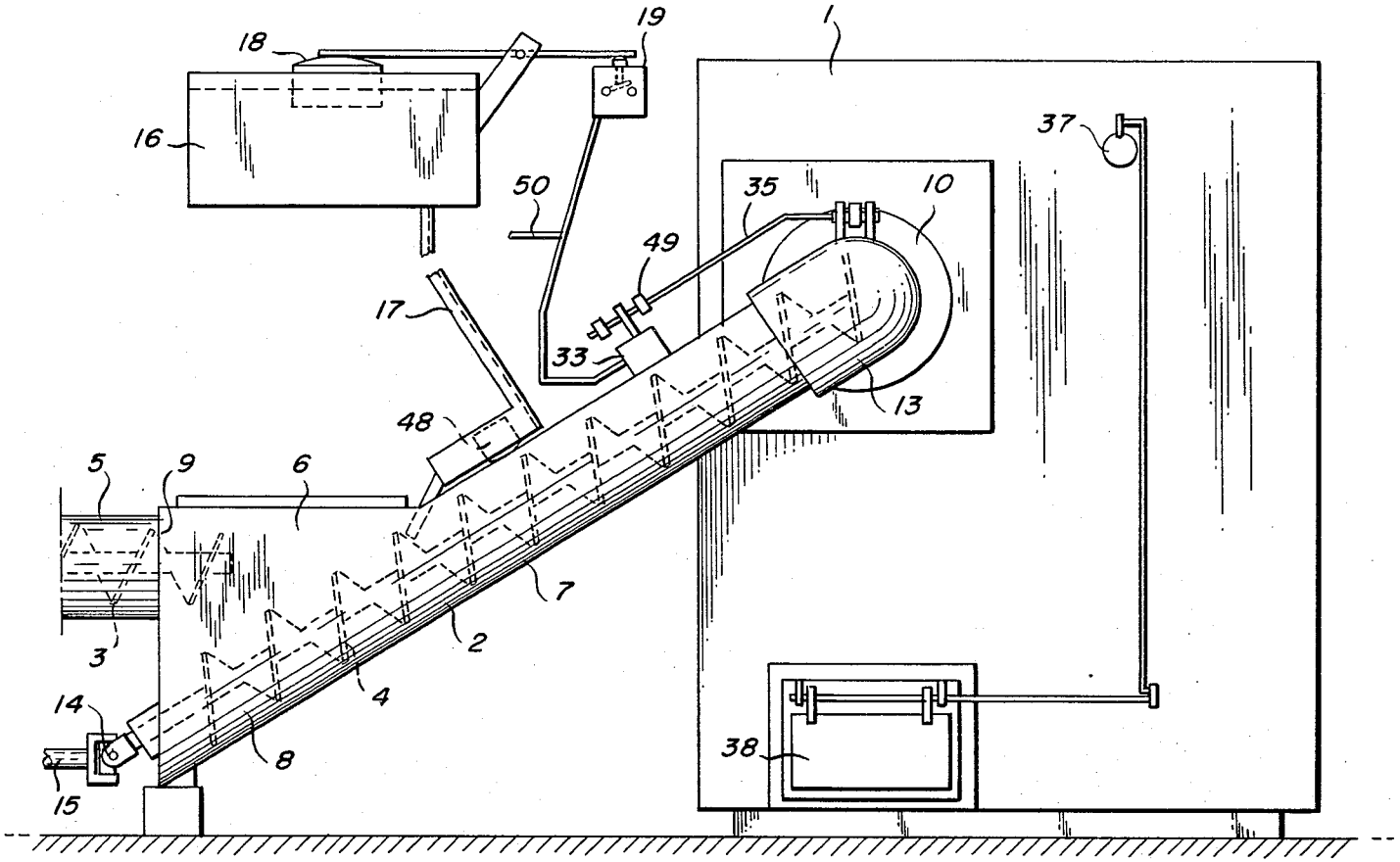
FIG. 1 illustrates the firing installation seen from the side connected to a boiler.
Figure 3:
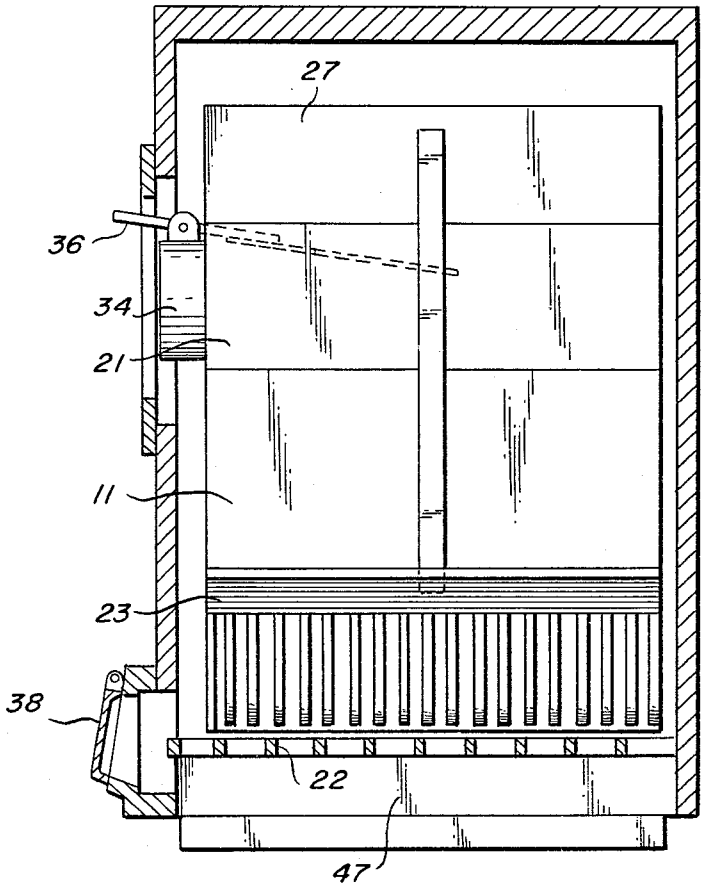
FIG. 3 is a cross section of the boiler at right angles to the one shown in FIG. 2 and taken between the chip chamber and the inner separating wall, discernible in FIG. 2, in the boiler.

The inventive burner unit is formed for firing with shavings or chips in a boiler 1. The unit is provided with a stoker apparatus 2 for feeding the shavings or the chips to the boiler 1 from a storage container.

The stoker apparatus 2 is provided with two conveyor screws, a horizontal one 3 and an upper one 4, which are driven by a common motor but with different speeds by selection of different large gears on the respective conveyor screw 3 and 4.

The conveyor screws 3 and 4 coact for feeding the shavings or the chips to the boiler 1 by the horizontal screw 3 being mounted in a horizontal first pipe 5, which opens out in a quenching chamber 6, in which the charging end 8 of the upper conveyor screw 4 is mounted at a lower level in said chamber 6 than the discharge end 9 of the horizontal conveyor screw 3. There is thus obtained a uniform feed of the shavings or the chips used as fuel, so that packing of the fuel is avoided in the stoker apparatus 2.

Figure 2:
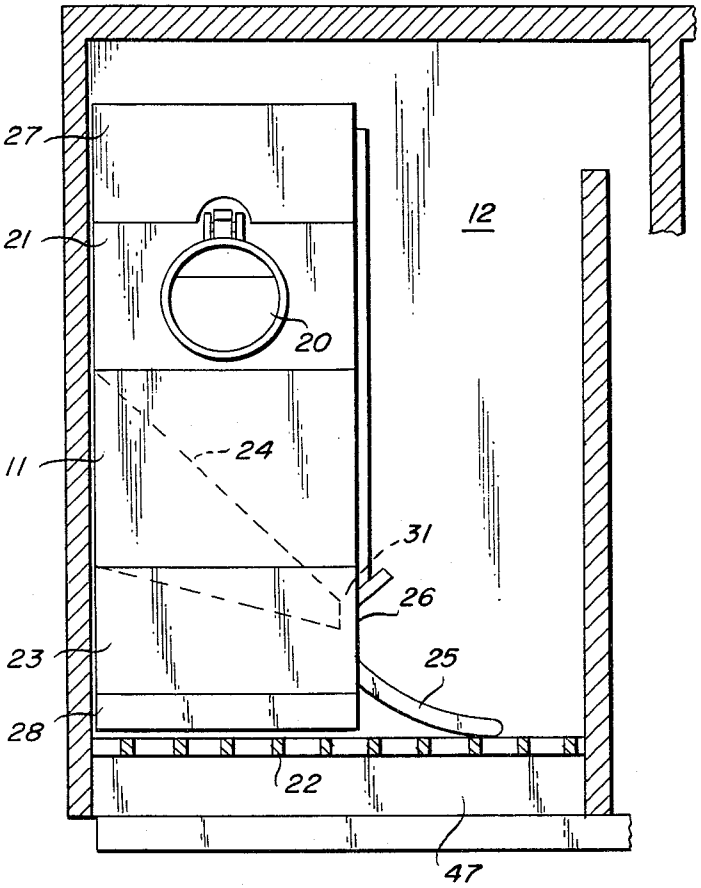
FIG. 2 is a cross section of the boiler adjacent its hearth openings with the inventive chip chamber installed above the fire bars of the boiler.

The upper feed screw 4 goes from the quenching chamber 6 in a second pipe 7 sloping upwards towards an input 10 on the boiler 1 of a chip chamber 11, which is placed inside the boiler 1 in the combustion room 12 (see FIG. 2).

For this purpose the upper conveyor screw 4 is parted at its upper end and provided with a universal joint and is enclosed by a curved pipe portion 13.

The upper conveyor screw 4 runs through a seal out from the quenching chamber 6 and is connected to a horizontal driving shaft 15 by means of a universal joint 14, parallel to the horizontal conveyor screw 3, whereby both driving shafts from the electric motor are parallel.

The quenching chamber 6 is connected to a quenching apparatus for avoiding backfiring, e.g. if there is a current supply failure. The quenching apparatus comprises a water tank 16 which is connected by means of a pipe 17 to the upper conveyor screw 4. At its outer end this pipe 17 is provided with a wax plug 48. There is a float 18 in the water tank 16 for actuating a main switch 19 to the electric motor of the stoker apparatus 2.

If the shavings or the chips begin to burn in the second pipe 7 of the stoker apparatus 2, e.g. during a power failure, the wax plug 48 melts in the outer end of the pipe 17, so that the water in the watertank 16 runs out to the quenching chamber 6 and quenches the burning shavings or chips. As water is emptied from the watertank 16, the float 18 sinks and interrupts the current via the main switch 19 so that the motor of the stoker apparatus 2 is stopped. The quantity of water in the watertank 16 is selected such that it fills the quenching chamber 6 so that backfiring towards the main supply of fuel for the burner units is made impossible.

The wax plug 48 in the outer end of the pipe 17 operates as a melting fuse and is provided with an expansion chamber with a grid. If the plug should not melt entirely, it is still displaced to the expansion chamber by the water pressure. The quenching water thus obtains a free passage passed the wax plug 48. The watertank 16 is connected by a feed pipe to the boiler 1. A fireproof and operationally reliable form of the stoker apparatus 2 to the inventive burner unit is hereby obtained.

From the input 10 to the boiler 1, the stoker apparatus 2 is connected via a feed stub 20 to a chip chamber 11 built up in the combustion chamber 12 of the boiler 1, said stub being arranged in an upper portion of the boiler 1.

The upper part 21 of the chip chamber 11 is connected via the feed stub 20 to the input 10 for the chips fed in by the stoker apparatus 2.

The chip chamber 11 is formed as a part of the predesiccating chamber for the chips, which is built up inside the combustion chamber 12 of the boiler 1, above the fire bars 22 of the boiler 1.

At its lower part, the predesiccating chamber is formed with a combustion part 23 for the chips.

A sloping plane 24 is arranged in the chip chamber 11 for supplying the chips by gravity to an adjustable firing grid 25 in the combustion part 23. The chips are ignited on this firing grid. The flame thus occurring gives off heat both for operating the boiler and for drying out the newly filled fuel. The firing grid 25 is situated at an outlet 26 for the chips, which have been predried in the predesiccating chamber. The outlet 26 is adapted under the chip chamber 11. The angle of slope of the firing grid 25 is freely adjustable.

The chip chamber 11 and its upper part 21, as well as the combustion part 23 and an upper part 27 of the chip chamber 11 plus a bottom part 28 together form the predesiccating chamber, and are formed as separate building components with the same form in their upper and lower parts and are formed insertable in an existing boiler, as well as being stackable one on top of the other inside the boiler.

For keeping together the different building components 11, 21, 22, 23, 27, 28 of the predesiccating chamber, they are provided with location pins 29 and hooks 30 (see FIG. 6) for joining up with their undersides to the upper side of the component beneath.

For regulating the feed of the chips dried in the predesiccating chamber through the outlet 26 from the chip chamber 11 to the firing grid 25, there is a gap 31 formed between the lower end of the sloping plane 24 and the wall of the predesiccating chamber.

The control means for regulating the amount of chips fed in by the stoker apparatus 2 is formed with a regulating means 32 inserted in the predesiccating chamber 11. (See FIGS. 5 and 9.) This is formed so as to accompany by gravity the downward movement of the chips in the predesiccating chamber 11. The stoker apparatus 2 is started at a given position of the regulating means 32. The chip chamber 11 is filled until the regulating means 32 is lifted by the chips fed in. At a given level, the means 32 stops the stoker apparatus 2.

Operational control of the burner unit is obtained by a motor safety switch and an operation relay 33. The operation relay 33 is actuated by a level control means consisting of the regulating means 32, which is pivotably carried by a bracket 34 projecting out from the side of the chip chamber 11, and a rod 35 which is hingedly displaceable between the end of the portion 36 of the means 32 projecting outside the bracket 34 and the operation relay 33.

Operational control otherwise takes place to prevent overheating of the boiler water in the boiler 1. This is done by having the existing thermostat 37 on the boiler coupled to the existing draught hatch 38 on the boiler for the supply of primary air to the boiler.

Supplementary supply of secondary air can be arranged by means of a rosette valve adapted on the boiler, if the proportion of water in the fuel so requires.

For preventing overheating of the boiler 1, e.g. due to a particle being fastened between the hatch 38 and its stop, there is an electrical overheating protector on the water jacket on the boiler 1. This is set at 75°–80° C. and connected by an electric lead in series with the operation relay 33 and main switch 19 at the water tank 16 for the automatic quenching of a backfire. When the particle has been removed, or combustion in the firing chamber of the boiler 1 has decreased, the unit returns to normal operation.

In FIG. 13 there is illustrated a regulating part 39, with which feed to the firing grid 25 is adjustable. The firing grid 25 is pivotable about an axis 40, shown in FIG. 12, which is thrust into holes in the wall of the combustion part 23.

The predesiccating chambers combustion part 23, chip chamber 11, the chip chamber upper part 21 and uppermost part 27 of the chip chamber are fastened together and locked by a connecting iron 41 on one side of the predesiccating chamber (see FIG. 7 and FIG. 4).

The sloping plane 24 in the chip chamber 11 is supplemented with a flat part 42, which is provided with openings 43 for end hooks 44, which are arranged in the bottom edge of the sloping plane 24. The flat portion 42 also rests against a support shaft 45, which is inserted in the combustion part 23 parallel to the fire bars 22 of the boiler 1.

The boiler 1 is also provided with hooks 46 for retaining the chip chamber 11, 21, 23, 27, 28 against the inside of the boiler 1 (see FIG. 14).

The function of the burner unit will be described in detail in the following.

Shavings or chips from a main supply are fed by the horizontal conveyor screw 3 in the stoker apparatus 2 over the quenching chamber 6 with interrupted mechanical connection to the upper conveyor screw 4 in the stoker apparatus 2. The upper conveyor screw 4 is parted by the universal joint and feeds the chips into the predessication chamber 11, 21, 23, 27, 28, which is built up inside the combustion chamber 12 of the boiler 1 above the fire bars 22 of the boiler 1 so that the ash chamber will be retained.

Combustion of the shavings or the chips is done on the adjustable fire grid 25 of the burner unit, said grid being supplied with fuel from the chip chamber 11. This fuel is fed through the gap 31 between the sloping plane 24 and the wall of the predessication chamber. The feed is done by gravity and by the fuel turning into ash as it is burnt, the ash falling through the gaps of the firing grid 25 and into the ash chamber 47 under the fire bars 22 of the boiler 1.

For the fire safety of the burner unit, it is, as has previously been described, provided with two regulating means. The one is intended for operational regulation and comprises the regulating means 32 for mechanical level regulation of the quantity of fuel in the chip chamber 11 of the predessication chamber. The other comprises the melting fuse formed by a wax plug 48 for water quenching, and the float 18 in the water tank 16 and its coaction with the main switch 19, which cuts off all current to the burner unit as the water tank 16 is emptied.

The quenching itself is done by the quenching chamber 6 being completely filled with water so that the second pipe 7 of the stoker apparatus 2, leading to the boiler 1 is closed off by the water level. The burner unit is particularly intended for firing with raw shavings or raw chips.

Combustion of the fuel is done by oxygen supply through the ordinary draught hatch 38 of the boiler 1 and by the automatic draught resulting from the subpressure obtained via the chimney to the boiler 1. Combustion of the fuel results in that the fuel in the predessication chamber 11, 21, 23, 27, 28 sinks, which actuates the regulating means 32. The movement of the regulating means 32 actuates an electric switch 49, which is formed for end position actuation. The horizontal screw 3 and the upper screw 4 in the stoker apparatus 2 hereby starts for a dropping quantity of fuel in the predesiccation chamber 11, 21, 23, 27, 28 so that said chamber is filled until the regulating means 32 is lifted. The electrical switch 49 is then actuated by the lifted regulating means 32, and interrupts the current to the motor (not shown on the drawings) of the two conveyor screws 2, 3. The electrical connections 50 to the motor are shown in FIG. 1.

The size of the parts forming the predesiccation chamber 11, 21, 23, 27, 28 and the size of the firing grid 25 are formed so that the chamber and grid can be built up by being put together inside the boiler 1 after each part has been inserted into the boiler through the existing firing hatches on it. To enable such an assembly, each portion is provided with hooks 30 and locating pins 29 and the predesiccation chamber 11, 21, 23, 27, 28 is provided with the connecting iron 41.

I claim:

1. A burner unit for shavings or chips for firing in a boiler, including a combustion chamber, fire bars and a stoker apparatus for feeding the chips to the boiler comprising:

a feeder stub, said stoker apparatus of the burner unit being connected to said feeder stub arranged in an upper portion of the boiler;

control means for the burner unit for regulating the quantity of chips fed by the stoker apparatus;

a predesiccation chamber for the burner unit being positioned inside the combustion chamber of the boiler above the fire bars in the boiler;

said predesiccation chamber being formed of several separate building components with the same shape at their upper and lower portions, and with mainly closed side walls;

said building components being insertable into an existing boiler and being stackable one on the top of the other within the boiler;

an upper portion of said building components being adapted to receive the chips fed in through the feeder stub;

a middle portion of said building components is a chip chamber provided with a sloping plane for feeding chips to an adjustable firing grid; and a lower portion of said building components is formed for the combustion of the chips and for the ignition of the chips;

said firing grid being formed as an outlet below the chip chamber.

2. A burner unit according to claim 1, wherein the building components are provided with locating pins and hooks for joining their bottom portion onto the adjacent portion of the building component underneath.

3. A burner unit according to claim 1 or 2, wherein a gap is formed between the lower end of the sloping plane and the wall of the predesiccation chamber to regulate the feed of the dried chips from said chamber.

4. A burner unit according to claim 1, and further including a watertank operatively connected to said stoker apparatus for selectively extinguishing a backfire therein.

5. A burner unit according to claim 4, and further including a control member for selectively communicating said water from said watertank to said stoker apparatus.

6. A burner unit according to claim 5, wherein said control member is a wax plug.

* * * * *